US006965745B2

(12) United States Patent
Jensen et al.

(10) Patent No.: US 6,965,745 B2
(45) Date of Patent: Nov. 15, 2005

(54) IMAGING CONSUMABLES METERING

(75) Inventors: C. Troy Jensen, Caldwell, ID (US); David M. Payne, Star, ID (US); Tim M. Hoberock, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/280,412

(22) Filed: Oct. 25, 2002

(65) Prior Publication Data

US 2004/0081486 A1 Apr. 29, 2004

(51) Int. Cl.[7] ..... G03G 15/08
(52) U.S. Cl. ..... 399/260; 399/255
(58) Field of Search ..... 399/258, 260, 399/255, 272, 281; 222/135, 136, 145.5, 222/145.6, DIG. 1

(56) References Cited

U.S. PATENT DOCUMENTS

| | | | | |
|---|---|---|---|---|
| 3,599,682 | A * | 8/1971 | Altmann | 141/106 |
| 4,349,132 | A * | 9/1982 | Macaluso et al. | 222/156 |
| 4,435,065 | A * | 3/1984 | Wada | 399/260 |
| 4,650,097 | A * | 3/1987 | Hagihara et al. | 222/161 |
| 4,699,495 | A * | 10/1987 | Hilbert | 399/234 |
| 4,919,071 | A * | 4/1990 | Gatti | 399/111 |
| 4,993,829 | A * | 2/1991 | Naganuma et al. | 399/260 |
| 5,430,530 | A * | 7/1995 | Ott et al. | 399/256 |
| 5,815,780 | A * | 9/1998 | Boerger | 399/260 |
| 5,943,537 | A * | 8/1999 | Ahn | 399/254 |

* cited by examiner

*Primary Examiner*—Robert Beatty

(57) ABSTRACT

A container for flowable materials includes a first chamber storing flowable material within the container. A second chamber is separated from the first chamber within the container and contains a stirrer. A metering mechanism permits selective transfer of flowable material from the first chamber to the second chamber.

20 Claims, 3 Drawing Sheets

IMAGING CONSUMABLES METERING

FIELD OF THE INVENTION

The invention relates generally to the storage and dispensing of consumables in imaging systems. Specifically, the invention relates to the storage of toner within hoppers in cartridges in electrostatic printing (EP) imaging systems.

BACKGROUND OF THE INVENTION

Imaging systems such as printers, fax machines, and copiers are virtually omnipresent, and can be found in homes and offices worldwide. The development of such systems has facilitated improvements in communications that have in turn fostered profound changes in the ways that people live and work. Telecommuting, "virtual" offices, and intra-office networks represent but a few examples of the advancements that have been made possible by modern imaging systems.

Imaging systems using electrostatic printing have found wide acceptance. In electrostatic printing, toner stored in a hopper is deposited on a media sheet, then heat-fused to the media sheet. Within the hopper are stirrers to maintain the toner in particulate form by preventing coalescing, or "clumping", of the toner. Stirrers also serve to transfer toner towards the developer drum, and create a dusting of toner to assist the developer roller in attracting toner particles to the developer roller surface.

One example of hopper stirrer arrangements is set forth in U.S. Pat. No. 5,854,961 to Hoberock, which is directed to a toner delivery and metering apparatus including a generally U-shaped or trough member which is operative to receive toner material. The dry, non-magnetic toner particles are agitated and stirred with an oscillating or rotating stirrer blade and passed between the sidewalls of a toner supply rod. The toner supply rod is rotatably mounted in the bottom of the trough member, and is operative to pass the toner particles onto the surface of the applicator and charging roller by a controlled oscillatory and agitating motion at the lower opening within the trough member.

Typical color toner particles are comprised of EP-enhancing particulates bonded to the surface of colorized polymers. Since mechanical stirrers contact particles that remain in the hopper as well as those that are transferred, particles within the hopper can be subjected to repeated and unnecessary contact with the stirrer elements. The particulate/polymer bonds can become damaged by contact with the mechanical stirrers, thus causing the toner to act inconsistently with the EP process. This inconsistency degrades print quality, and shortens the life of the cartridge/toner.

In an attempt to reduce stirrer/particulate contact, hoppers have been developed in which a primary stirrer in contact with most of the toner is used infrequently, while a smaller, secondary stirrer operates constantly in a conventional manner.

While known "two-level" stirring reduces particulate damage somewhat, such arrangements still cause unnecessary particulate damage due to constant stirrer/particulate contact. It can be seen from the foregoing that the need exists for a simple, inexpensive, arrangement for minimizing particulate damage in toner hoppers.

SUMMARY OF THE INVENTION

The present invention is directed to a container for flowable materials including a first chamber storing flowable material within the container. A second chamber is separated from the first chamber within the container and contains a stirrer. A metering mechanism permits selective transfer of flowable material from the first chamber to the second chamber.

DETAILED DESCRIPTION OF THE INVENTION

Figure 1:
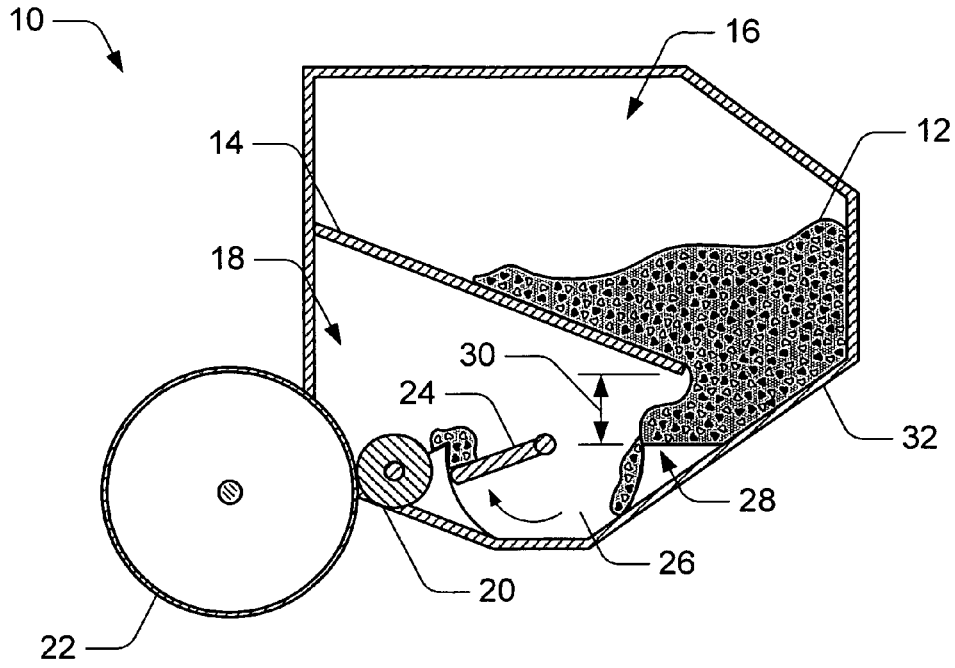
FIG. 1 is a schematic sectional view of a container in accordance with the principles of the present invention.

An embodiment of a container 10 in accordance with the principles of the present invention is shown in FIG. 1. The container 10 is adapted and constructed to hold a predetermined quantity of consumable flowable material, such as toner 12, for use in an imaging system (not shown).

An angled partition 14 divides the interior of the container 10 into a first, storage chamber 16, and a second, distribution chamber 18. A distribution mechanism, such as an applicator roller 20, is located within the distribution chamber 18. The applicator roller 20 receives toner from within the distribution chamber 18, and distributes it to an EP drum 22 for transfer to imaging sheet material. A stirrer 24 rotates within a stirrer well 26 to facilitate uniform distribution of the toner 12.

A metering mechanism 28 is provided between the storage chamber 16 and the distribution chamber 18. The metering mechanism 28 selectively regulates the amount of toner 12 flowing from the storage chamber 16 to the distribution chamber 18. In the FIG. 1 embodiment, the metering mechanism 28 takes the form of an opening 30 between the partition 14 and an outer wall 32 of the container 10 sized to restrict the flow of toner 12 between the storage chamber 16 and the distribution chamber 18. Toner 12 is gravity-fed through the opening 30 to the stirrer well 26 to supply toner on demand. Rotation of the stirrer 24 causes excess toner to be "splashed" back to the outside of the stirrer well 26, thus permitting an appropriate amount of toner to flow freely to the stirrer 26.

Figure 2:
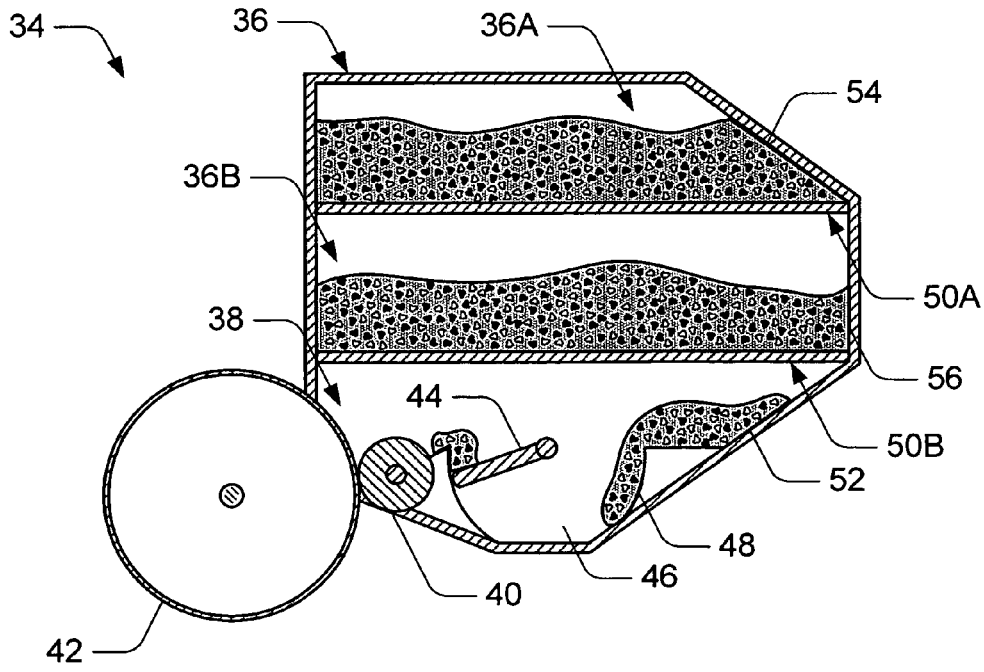
FIG. 2 is a schematic sectional view of an alternative embodiment of a container in accordance with the principles of the present invention.

An alternative embodiment of a container 34 incorporating the principles of the present invention is shown in FIG. 2. The interior of the container 34 is divided into a first, storage chamber 36, and a second, distribution chamber 38. A distribution mechanism, such as an applicator roller 40, is located within the distribution chamber 38. The applicator roller 40 receives toner from within the distribution chamber 38, and distributes it to the EP drum 42 for transfer to imaging sheet material. A stirrer 44 rotates within a stirrer well 46 to facilitate uniform distribution of toner 48 within the distribution chamber 38, and to deliver toner to the applicator roller 40.

The storage chamber 36 is divided into a plurality of storage sub-chambers 36A, 36B. The storage sub-chambers 36A, 36B are formed by a series of selectively opening closure members 50A, 50B within the storage chamber 36. The closure members 50A, 50B are shown in the form of removable partitions. It is also contemplated that the closure members 50A, 50B could be provided as "hoppers" with angled bottoms sloping downwardly to a selectively actuated opening or openings. Irrespective of their specific construction, the closure members form a metering mechanism capable of serially supplying fresh (not mechanically agitated) "batches" of toner to the distribution chamber 38, so that only one zone of toner is in process at a given time.

In practice, when the container is originally installed, the distribution chamber 38 is provided with an initial batch of toner 52. When a trigger event has occurred, e.g., depletion of the batch of toner 52 or a predetermined number of images have been processed by the imaging system, the closure member 50A opens, thus allowing a batch of toner 54 contained within the sub-chamber 36A to flow into the distribution chamber 38. Similarly, once when a second trigger event has occurred, e.g., depletion of the batch of toner 54 or an additional predetermined number of images have been processed by the imaging system, the closure member 50B opens, thus allowing a batch of toner 56 contained within the sub-chamber 36B to flow into the distribution chamber 38.

Figure 3:
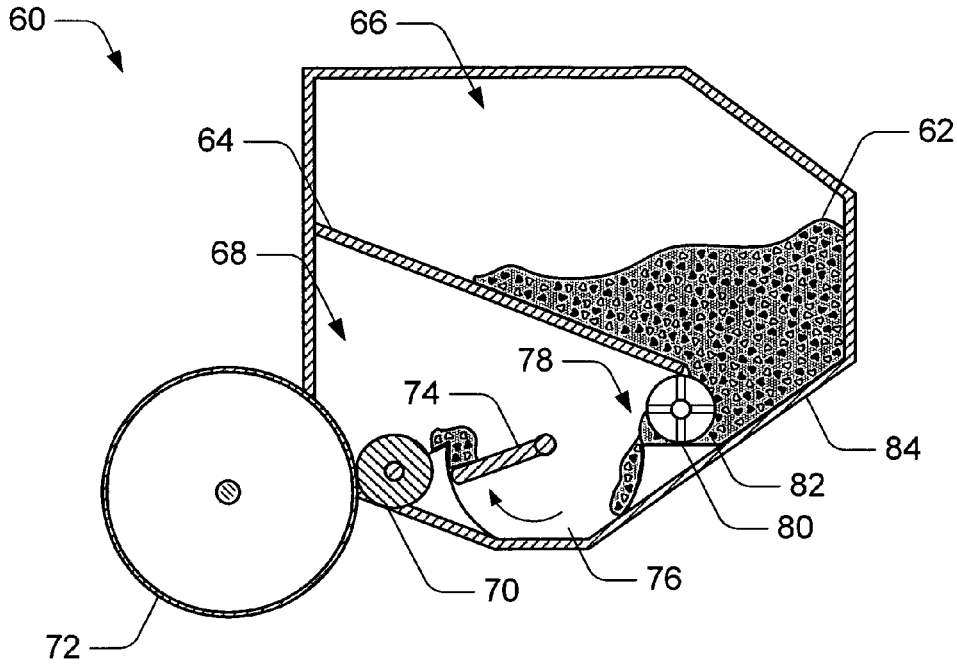
FIG. 3 is a schematic sectional view of an alternative embodiment of a container in accordance with the principles of the present invention.

Yet another embodiment of a container 60 in accordance with the principles of the present invention is shown in FIG. 3. The container 60 is adapted and constructed to hold a predetermined quantity of consumable flowable material, such as toner 62, for use in an imaging system (not shown).

An angled partition 64 divides the interior of the container 60 into a first, storage chamber 66, and a second, distribution chamber 68. A distribution mechanism, such as an applicator roller 70, is located within the distribution chamber 68. The applicator roller 70 receives toner from within the distribution chamber 68, and distributes it to an EP drum 72 for transfer to imaging sheet material. A stirrer 74 rotates within a stirrer well 76 to facilitate uniform distribution of the toner 62.

A metering mechanism 78 is provided between the storage chamber 66 and the distribution chamber 68. The metering mechanism 78 selectively regulates the amount of toner 62 flowing from the storage chamber 66 to the distribution chamber 68. In the FIG. 3 embodiment, the metering mechanism 78 takes the form of a paddle wheel 80 located in an opening 82 between the partition 64 and an outer wall 84 of the container 60. The paddle wheel 80 rotates to meter individual batches or loads of toner into the distribution chamber 68. The paddle wheel 80 can be stopped at "closed" increments to minimize leaking during removal, installation, and transport of the container 60. It is also contemplated that an alternative incremental feed mechanism, such as an auger, could be located and operated in a similar manner.

Figure 4:
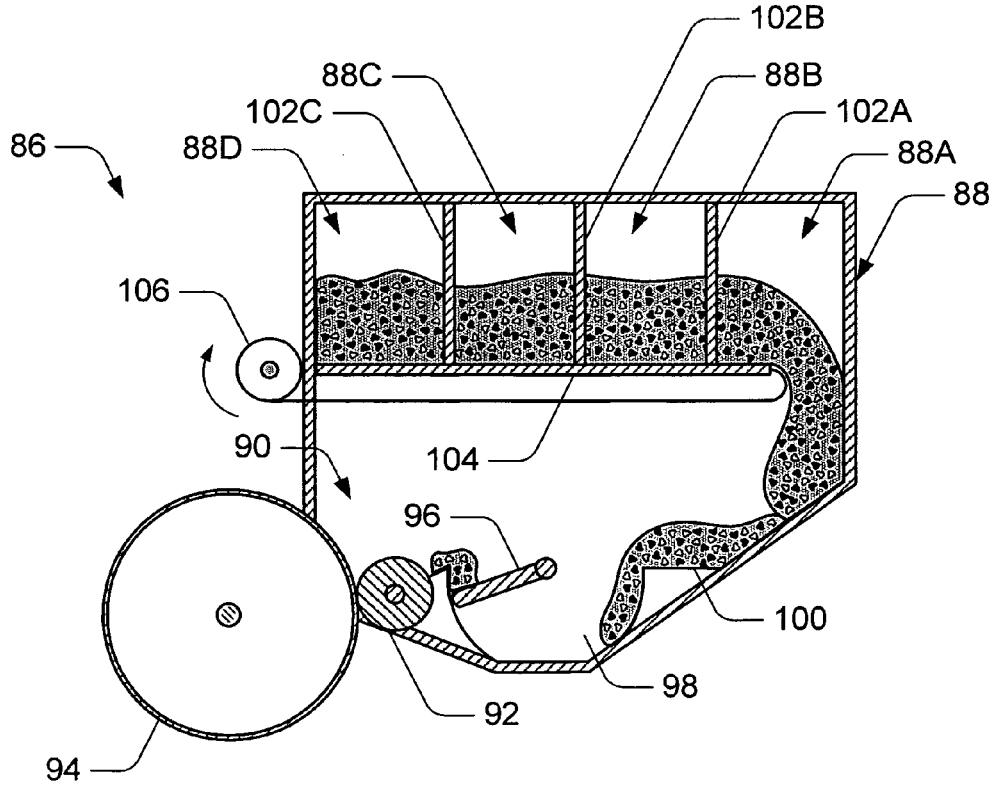
FIG. 4 is a schematic sectional view of an alternative embodiment of a container in accordance with the principles of the present invention.

Another alternative embodiment of a container 86 incorporating the principles of the present invention is shown in FIG. 4. The interior of the container 86 is divided into a first, storage chamber 88, and a second, distribution chamber 90. A distribution mechanism, such as an applicator roller 92, is located within the distribution chamber 90. The applicator roller 92 receives toner from within the distribution chamber 90, and distributes it to the EP drum 94 for transfer to imaging sheet material. A stirrer 96 rotates within a stirrer well 98 to facilitate uniform distribution of toner 100 within the distribution chamber 90, and to deliver toner to the applicator roller 92.

The storage chamber 88 is divided into a plurality of storage sub-chambers 88A, 88B, 88C, 88D. The storage sub-chambers 88A, 88B, 88C, 88D are formed by a series of dividers 102A, 102B, 102C within the storage chamber 88. A selectively retractable closure membrane 104 seals the bottoms of the storage sub-chambers 88A, 88B, 88C, 88D. A retraction mechanism, such as a take-up roller assembly 106, is connected to the closure membrane 104. The retraction mechanism is adapted to selectively remove the closure membrane 104 from the respective bottoms of the storage sub-chambers 88A, 88B, 88C, 88D to serially supply fresh (not mechanically agitated) "batches" of toner to the distribution chamber 90, so that only one zone of toner is in process at a given time. It is contemplated that the retraction mechanism will be actuated through the control mechanism of the imaging system, either electronically, or mechanically by being slaved to the gear train via a reduction gear.

Figure 5:
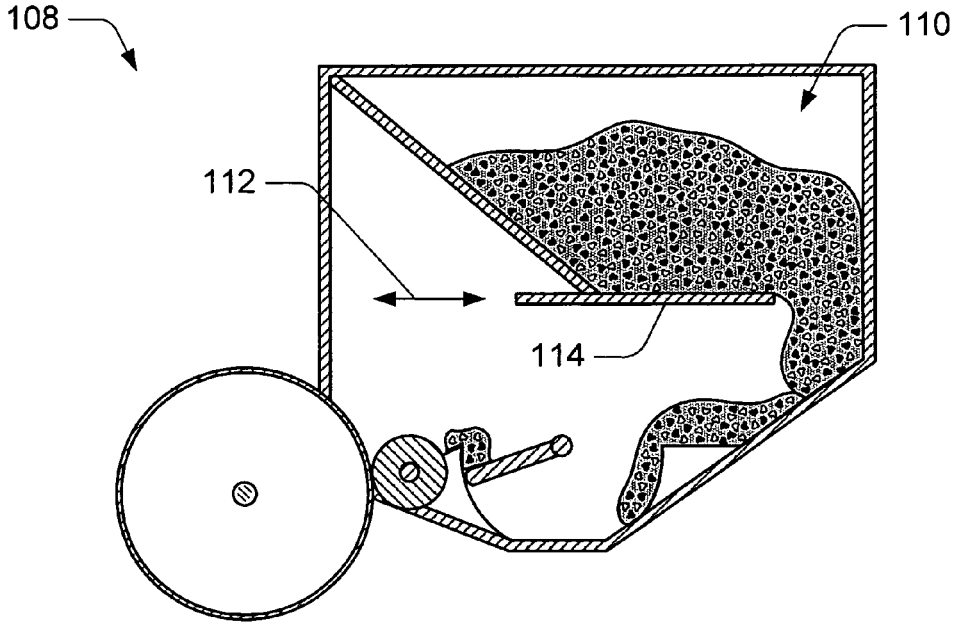
FIG. 5 is a schematic sectional view of an alternative embodiment of a container in accordance with the principles of the present invention.

Another alternative embodiment of a container 108 incorporating the principles of the present invention is shown in FIG. 5. The interior of the container 108 is divided into a first, storage chamber 110, and a second. distribution chamber 112. Distribution mechanisms and including an applicator roller, EP drum, and stirrer are provided as previously described.

The storage chamber 110 is separated from the distribution chamber 112 by a selectively opening closure member 114. The closure member 114 reciprocates horizontally, thus supplying fresh (not mechanically agitated) "batches" of toner to the distribution chamber 112, so that only a limited amount of toner is in process at a given time. When a trigger event has occurred, the closure member 114 briefly opens, thus allowing a predetermined amount of toner to flow into the distribution chamber 112.

Figure 6:
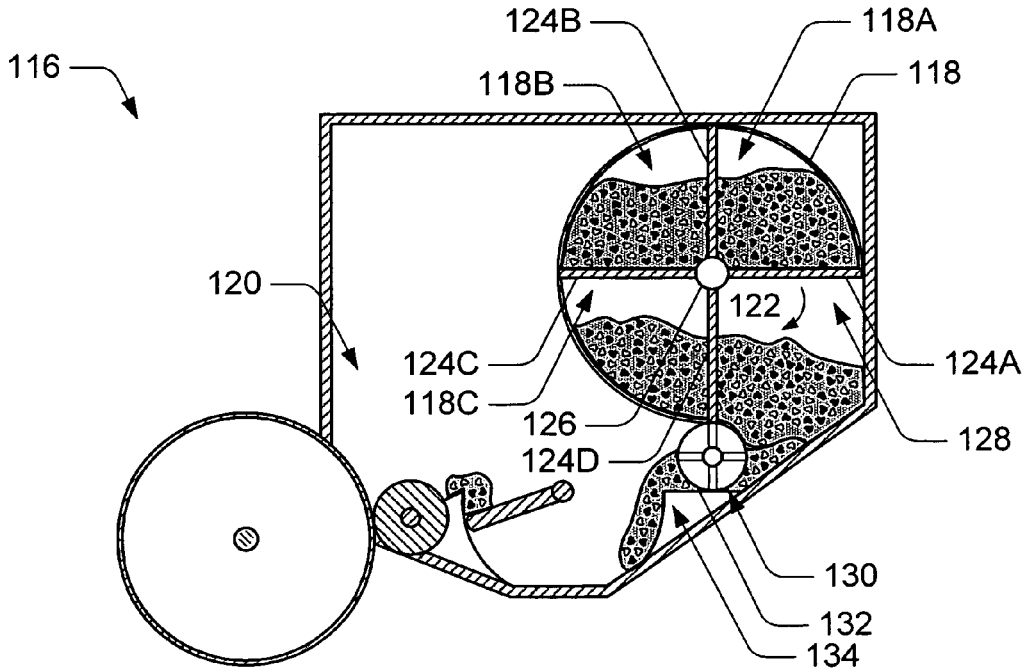
FIG. 6 is a schematic sectional view of an alternative embodiment of a container in accordance with the principles of the present invention.

Yet another embodiment of a container 116 in accordance with the principles of the present invention is shown in FIG. 6. The interior of the container 116 is divided into a first, storage chamber 118, and a second, distribution chamber 120. Distribution mechanisms and including an applicator roller, EP drum, and stirrer are provided as previously described.

The storage chamber 118 is separated into a plurality of sub-chambers 118A, 118B, 118C by a rotatable divider 122. The divider 122 includes a plurality of dividers 124A, 124B, 124C, 124D extending radially from a central hub 126. As toner is consumed, the divider 122 is selectively incrementally rotated to dispense the contents of the respective chambers into a holding chamber 128.

A metering mechanism 130 is provided between the holding chamber 128 and the distribution chamber 120. The metering mechanism 130 takes the form of a paddle wheel 132 located in an opening 134 between the holding chamber 128 and the distribution chamber 120. The paddle wheel 132 rotates to meter individual chargers or loads of toner into the distribution chamber 120. The paddle wheel 132 can be stopped at "closed" increments to minimize leaking during removal, installation, and transport of the container 116. It is also contemplated that an alternative incremental feed mechanism, such as an auger, could be located and operated in a similar manner.

The present invention isolates discrete quantities of flowable material for on-demand delivery to a distribution mechanism. Although the present invention has been described with reference to specific embodiments, those of skill in the art will recognize that changes may be made thereto without departing from the scope and spirit of the invention as defined by the appended claims.

What is claimed is:

1. A container for flowable materials comprising:

a first chamber configured to store flowable material within the container, the first chamber comprising a plurality of storage sub-chambers within the first chamber;

a second chamber separated from the first chamber within the container, the second chamber containing at least one flowable material distributing mechanism;

a stirrer located in the second chamber, and a rotatable metering mechanism configured to rotate between the first chamber and the second chamber for selective transfer of the flowable material from the first chamber to the second chamber.

2. A container in accordance with claim 1, wherein the rotatable metering mechanism is gravity-fed to rotate between the first chamber and the second chamber.

3. A container in accordance with claim 1, wherein the rotatable metering mechanism is a selectively opening closure member.

4. A container in accordance with claim 1, wherein the rotatable metering mechanism is a paddle wheel assembly configured to transfer the flowable material from the first chamber to the second chamber.

5. A container in accordance with claim 1, wherein the stirrer is configured to transfer the flowable material to an applicator roller.

6. A container in accordance with claim 1 wherein the stirrer is configured to transfer the flowable material to an applicator roller within the second chamber.

7. A container in accordance with claim 1, wherein the rotatable metering mechanism is further configured to regulate the transfer of the flowable material from the first chamber to the second chamber.

8. A container in accordance with claim 1, wherein the flowable material is not mechanically agitated when stored in the first chamber.

9. A container for flowable materials for use in an electrostatic imaging system, the container comprising:

a distribution chamber within the container, the distribution chamber being adapted and constructed to receive flowable material from at least one storage chamber that comprises a plurality of storage sub-chambers;

a stirrer within the distribution chamber; and a metering mechanism configured between the distribution chamber and the at least one storage chamber for selective transfer of the flowable material into the distribution chamber, the metering mechanism comprising at least one selectively opening closure member between the storage sub-chambers, and the at least one selectively opening closure member comprising at least one removable partition.

10. A container in accordance with claim 9, wherein the at least one storage chamber is connected to the metering mechanism.

11. A container in accordance with claim 10, wherein the metering mechanism is gravity-fed.

12. A container in accordance with claim 9, wherein the stirrer is configured to transfer the flowable material to an applicator roller.

13. A container in accordance with claim 9, wherein the stirrer is configured to transfer the flowable material to an applicator roller within the distribution chamber.

14. A method for storing and dispensing flowable materials in a container in an imaging system, the method comprising:

providing at least one storage chamber containing a quantity of flowable material, the at least one storage chamber comprising a plurality of interconnected storage sub-chambers;

providing a distribution chamber within the container, the distribution chamber containing a stirrer chamber;

providing a metering mechanism connecting the at least one storage chamber to the distribution chamber; and causing the metering mechanism to rotate between the at least one storage chamber and the distribution chamber to transfer the flowable material from the at least one storage chamber into the distribution chamber.

15. A method in accordance with claim 14, wherein providing the metering mechanism comprises providing a gravity-fed metering mechanism between the at least one storage chamber and the distribution chamber.

16. A method in accordance with claim 14, wherein providing the metering mechanism comprises at least one selectively opening closure member between the interconnected storage sub-chambers.

17. A method in accordance with claim 14, wherein providing the metering mechanism comprises providing a paddle wheel assembly to transfer the flowable material from the at least one storage chamber into the distribution chamber.

18. A method, comprising:

storing toner in divided sub-chambers within a storage chamber of an imaging system such that the toner is not mechanically agitated in the storage chamber; and regulating a transfer of the toner from the storage chamber to a distribution chamber where the toner is stirred for uniform distribution onto an applicator roller, the transfer of the toner being regulated with a metering assembly that rotates between the storage chamber and the distribution chamber.

19. A method as recited in claim 18, wherein the metering assembly is a paddle wheel configured to regulate the transfer of the toner from the storage chamber to the distribution chamber.

20. A method as recited in claim 18, wherein regulating the transfer of the toner includes transferring the toner from a divided sub-chamber to the distribution chamber regulated with the metering assembly.

* * * * *